United States Patent [19]

Byam

[11] 4,201,735

[45] May 6, 1980

[54] METHOD OF MANUFACTURING A CHOKE CONTROL DEVICE

[75] Inventor: Peter M. Byam, Shelby, N.C.

[73] Assignee: Fasco Industries, Inc., Shelby, N.C.

[21] Appl. No.: 940,707

[22] Filed: Sep. 8, 1978

[51] Int. Cl.[2] ..... F02M 1/12

[52] U.S. Cl. ..... 261/39 E; 123/119 F; 236/101 C; 236/DIG. 12; 337/103; 219/207; 219/511

[58] Field of Search ..... 261/39 E; 123/119 F; 236/101 C, DIG. 12; 337/103; 219/511, 206, 207, 253

[56] References Cited

U.S. PATENT DOCUMENTS

| | | | |
|---|---|---|---|
| 1,201,469 | 10/1916 | James | 236/DIG. 12 |
| 2,611,855 | 9/1952 | Turner | 219/511 |
| 3,339,043 | 8/1967 | Baak | 337/103 |
| 3,425,336 | 2/1969 | Bufkin et al. | 219/442 |
| 3,699,937 | 10/1972 | DePetris | 261/39 E |
| 3,752,133 | 8/1973 | Irish et al. | 261/39 E |
| 3,768,453 | 10/1973 | Hurst | 261/39 E |
| 3,806,854 | 4/1974 | Armstrong | 261/39 E |
| 3,972,311 | 8/1976 | DePetris | 261/39 E |
| 4,050,427 | 9/1977 | Hollins | 261/39 E |
| 4,083,336 | 4/1978 | Armstrong | 261/39 E |

*Primary Examiner*—Tim R. Miles

*Attorney, Agent, or Firm*—Shlesinger, Fitzsimmons & Shlesinger

[57] ABSTRACT

The device includes a thermostat which is potted or secured by epoxy in a recess in the closed end of a generally cup-shaped, dielectric housing. A generally disc-shaped, aluminum alloy casting is secured coaxially against an opening formed in the bottom of the housing, and against a PTC resistor which is positioned in the opening between the casting and the thermostat, and in electrical contact with the latter. A bimetallic coil is mounted in the open end of the housing with its inner end staked to an integral post on the Al casting, and with its free end mounted to unwind or rotate angularly in the housing with changes in ambient temperature. The Al casting functions as a heat sink which can be trimmed, before being secured in the housing, to calibrate the bimetel coil.

4 Claims, 4 Drawing Figures

METHOD OF MANUFACTURING A CHOKE CONTROL DEVICE

This invention relates to automotive carburetors, and more particularly to an improved thermostatic device for controlling the choke valve of a carburetor.

Most automobile carburetors include a device that thermally controls the choke valve, and determines when the valve is to be opened or closed. Units of the type described comprise three basic components. First, a bimetal, temperature-responsive device in the form of a coil, which functions much as a motor to move the choke valve into an open or closed position. Secondly, a positive temperature coefficient (PTC) device in the form of a resistor, which is employed to function as a self-regulating heater to operate the bimetal coil under certain circumstances. Thirdly, a thermal switch or thermostat, which is utilized to control the excitation of the PTC resistor.

Known choke control devices of the type described have the disadvantage that they are extremely difficult to assemble and calibrate. One such device, for example, has the thermostat fixed to the choke control housing, so that once assembled, there is no way to adjust the thermostat to assure that it will open or close an associated circuit within a specified temperature range. Another problem encountered with such known devices is that it heretofore has been extremely time consuming to assemble the associated bimetal coil element in a desired position in the housing so that its operating end will mesh properly with a mating component when subsequently mounted on a carburetor choke. It likewise has been difficult properly to assemble the coil in the housing so that, under certain conditions, the coil will open or close the associated choke valve within a predetermined interval of time.

It is an object of this invention, therefore, to provide an improved choke control device of the type described which is substantially more reliable and easier to assemble than prior such devices.

Still another object of this invention is to provide an improved choke control device which is constructed of components that can be assembled readily and accurately, so that the device can be properly calibrated with a minimal amount of skill and effort.

A further object of this invention is to provide an improved choke control device of the type described which utilizes improved means for mounting three basic components of the device to minimize and simplify the adjustments that are necessary for calibrating the device.

Another object of this invention is to provide an improved method of assemblying and calibrating thermostatic choke control devices of the type described.

Other objects of the invention will be apparent hereinafter from the specification and from the recital of the appended claims, particularly when read in conjunction with the accompanying drawings.

Figure 1:
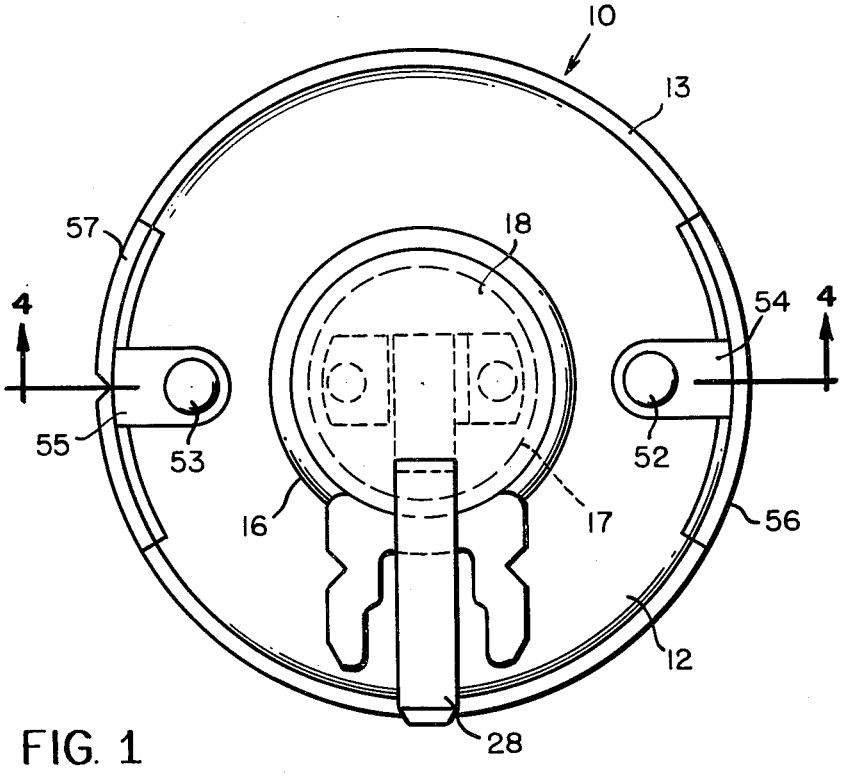
FIG. 1 is a rear elevational view of a thermostatic choke control device made according to one embodiment of this invention.
Figure 3:
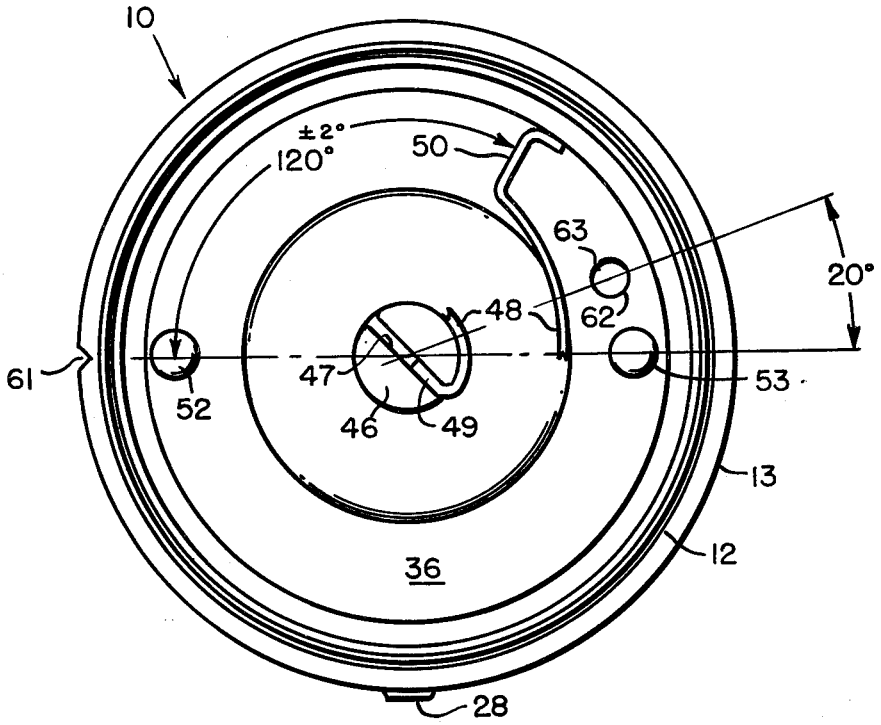
Figure 4:
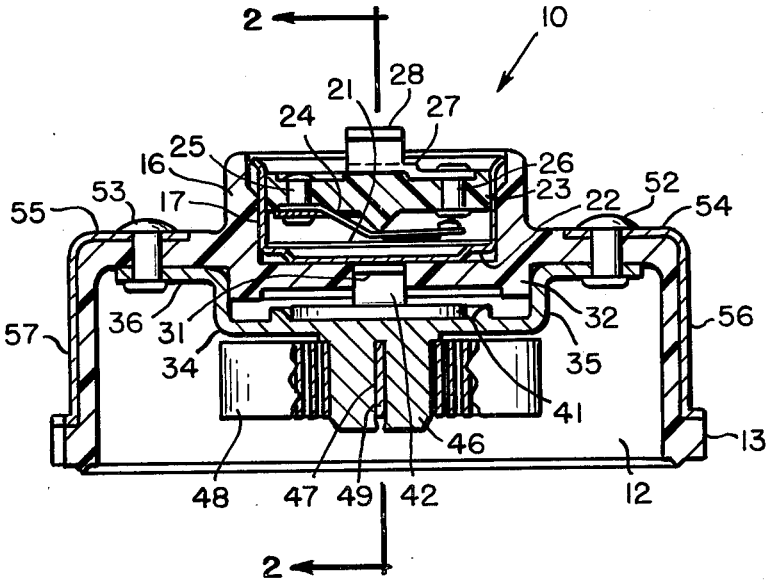

FIG. 3 is a front view of this control device, and illustrating the free end of the bimetal coil which is adapted to be connected to a mating part that operates the control valve of a carburetor choke; and FIG. 4 is a sectional view taken generally along the line 4—4 in FIG. 1 looking in the direction of the arrows, but with some parts shown in full, and with the potting layer of epoxy removed for purposes of illustration.

Referring now to the drawings by numerals of reference, 10 denotes generally a carburetor choke control device comprising a generally cup-shaped base or housing 12 made from a plastic, dielectric material, and surrounded adjacent its open end by an external circumferential flange 13. In its back or closed end housing 12 has therein a central, circular recess 15 (FIG. 2), which is surrounded by an annular flange 16. Secured in the recess 15 coaxially thereof is a generally cylindrically shaped thermostat housing 17. The back or outer surface of housing 17 is covered by a layer 18 of epoxy, which completely fills the outer end of the bore in flange 16 thereby to seal the thermostat housing 17 in the back of housing 12.

Housing 17, which is also generally cup-shaped in configuration (FIG. 4), has its closed end facing the bottom of recess 15 in housing 12, and has a disc-shaped, dielectric member 23 secured in, and closing, its outer or opposite end. The housing contains a bimetallic disc 21 (FIG. 4), the marginal edge of which is seated on an internal, circumferential flange or shoulder 22, which is formed in housing 17 adjacent its inner end. Mounted in housing 17 between discs 21 and 23 is a flexible, metallic, electrically conductive switch arm 24, one end of which is secured beneath the head of a rivet 25, which is secured in disc 23 adjacent one diametral side thereof. The opposite end of switch arm 24 overlies the head of another metal stud or contact member 26, which is secured in disc 23 diametrically opposite the stud 25. Secured beneath the opposite or outer end of the stud 26 is an offset portion 27 of an elongate, generally flat terminal 28, which projects from the back housing 17 through the epoxy layer 18, and then laterally downwardly and radially of the housing 12 as shown in FIGS. 1 and 2.

The inner end of housing 17 registers with an opening 31 (FIGS. 2 and 4) which is formed in the bottom of housing 12 centrally thereof. This opening is rectangular in configuration and surrounded by an annular boss 32, which projects coaxially from the bottom of housing 12 toward the open or lower end thereof as shown in FIGS. 2 and 4. Seated over this boss 32 coaxially thereof is the open end of a generally cup-shaped support member 34, which has an annular wall portion 35 that surrounds the boss 32, and an integral, circumferential flange portion 36, which projects laterally outwardly from the annular wall portion 35, and which is seated against the bottom of housing 12 around the outside of the boss 32. This flanged support member 34 is made from a thermally conductive metal such as, by way of example, an aluminum alloy casting, and is designed to function also as a heat sink, as noted hereinafter.

Secured in a shallow, circumferential recess formed centrally of the closed end of the support 34, and at the side thereof which faces the thermostat housing 17, is a thin, generally disc-shaped resistor 41 which is of the positive temperature coefficient (PTC) variety. One side of resistor 41 is secured flush against the closed end of support 34 by an adhesive of the type noted hereinafter; and the opposite side of the resistor is engaged by the closed end of a generally U-shaped, metal clip 42, the legs of which extend through the opening 31 at the bottom of housing 12, and which have curled or rolled end portions which engage the closed end of the thermostat housing 17 as at 44 and 45.

Figure 2:
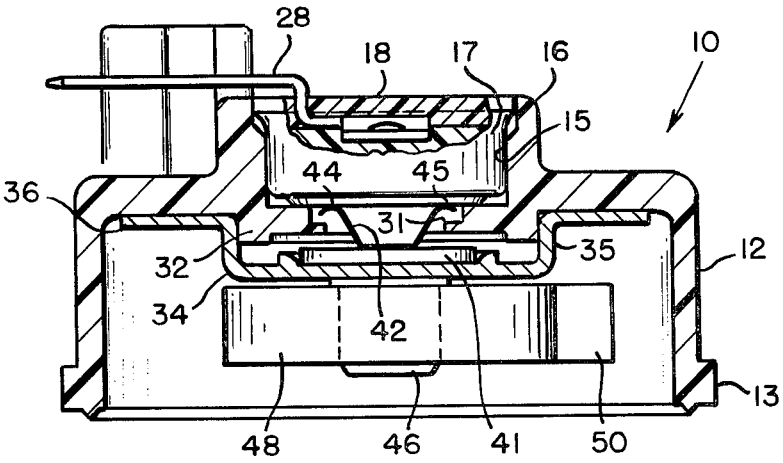
FIG. 2 is a sectional view taken along the line 2—2 in FIG. 4 looking in the direction of the arrows, but with parts thereof being shown in full.

Integral with the closed end of the support member 34, and projecting coaxially downwardly therefrom as shown in FIG. 2, is a reduced-diameter stud portion 46, which has in its outer end a diametral slot 47. Surrounding the stud 46 is a bimetallic coil 48 having an inner end 49 secured in the slot 47 in stud 46, and having a generally C-shaped outer end or tang 50, which is free to rotate angularly in opposite directions within the bore of housing 12 as noted hereinafter. The tang 50 at the free end of the coil 48 must be located in a predetermined position within housing 12 so that it will align properly with a mating part (not illustrated), which manipulates the choke valve of a carburetor, when the device 10 is in use.

The flange 36 of the support 34 is secured to the housing 12 by a pair of rivets 52 and 53 having headed outer ends beneath which are secured the legs 54 and 55, respectively, of a pair of arcuate, metal ground plates 56 and 57, which embrace opposite sides of the annular wall portion of housing 12. When housing 12 is mounted on an automobile engine, or the like, the ground plates 56 and 57 will be grounded to the automobile body.

Immediately adjacent to the rivet 52 the outer peripheral surface of housing 12 has therein an axially extending notch or slot 61 (FIG. 3) which is employed to relate the location of the bimetal tang 50 with its associated slot in the mating component (not illustrated) when the device is in use. Indexing means is also provided in the form of a circular opening 62, which is formed in the flange 36 of the support member to register with a spherical dimple or boss 63, which is formed in the bottom of housing 12 at a point angularly spaced 20° from the opening in the bottom of housing 12 through which the rivet 53 passes.

In order to function properly, it is necessary that the tang 50 be displaced approximately 120°, as shown in FIG. 3, from a radial plane extending through the notch 61 in housing 12. This angular relationship must be maintained in order to assure proper registry of the choke control device with its mating components (not illustrated), when the device 10 is subsequently mounted on an engine carburetor. In prior, known devices of the type described this presented an assembly problem, because the location of the tang 50 in relation to its mounting tab or inner end 49 varies from coil to coil. As a consequence, in practicing known methods of assembly, the notch 61 would be located at different angular positions relative to a plane through the centers of the studs 52 and 53. With applicant's improved device, however, it is possible always to locate the notch 61 at the same point on the housing, for example in a plane containing the axis of studs 52 and 53. This is made possible because of the different manner in which applicant's device is assembled.

For example, in accordance with the invention the inner end 49 of the bimetal coil 48 is first staked in the slot 47 in the stud 46 of the support 34 to fix the location of the coil relative to support 34. After this has been done the outer end or tang 50 of the coil is held in a fixture, while the index opening 62 and the two diametrally opposed openings, which are to accommodate the rivets 52 and 53, are punched into the flange 36 of the heat sink or support 34. During this operation the tang 50 is maintained 120° from the opening through which the rivet 52 is to pass, so that when member 34 is subsequently secured by the rivets 52 and 53 to housing 12, the notch 61 in housing 12, which is coplanar with the axes of the two openings in the bottom of housing 12 which are to accommodate the rivets 52 and 53, will likewise be positioned 120° (plus or minus 2°) from the tang 50. The opening 62 in the flange 36, also, will register properly with the index dimple 63 that is formed in the bottom of housing 12.

After the coil 48 has been fixed to the stud 46 on member 34, the resistor 41 is secured in the recess in the bottom of member 34 by means of an electrically conductive adhesive material, such as is sold, for example, by Amicon Corp. under the trademark "Uniset C906-93". This assembly is thereafter secured by the rivets 52 and 53 to the housing 12.

One of the important advantages of applicant's improved choke control device is the simplified manner in which each such device can be calibrated. For proper operation it is necessary that the bimetal tang 50 rotate 45° within a predetermined number of seconds after the application of 7.2 volts, DC, is applied across the resistor 41. This can be done, for example, by applying the positive side of the voltage source to the terminal 28, and heating the switch 17 until the disc 21 bows at its center to close the switch arm 24 against the contact 26. This completes a circuit through the metal clip 42, the resistor 41, the metal heat sink 34 and the rivets 52 and 53 to the ground terminals 56 and 57. The voltage drop across the resistor 46 causes it to heat; and this heat is passed through the heat sink 34 toward the coil 48, the low expansion side of which faces outwardly, so that the coil tends to unwind or to rotate clockwise about the axis of the post 46 as shown in FIG. 3.

The rate at which the coil 48 unwinds depends on several factors, including the deflection constant of the bimetal employed in the coil, the thickness of the bimetal strip formed in the coil, the total active length of the coil, the resistance curve of the PTC resistor 41, which in conjunction with the applied voltage determines the wattage output of the heater (resistor) for a given time, the thermal conductance from the heater (resistor 41) to the heat sink, as represented by the support 34, and the heat transfer from the heat sink to the bimetal coil 48. One of the principal disadvantages of known devices of the type described is that the PTC resistor-heater is attached to a metal heat sink comprising a brass stud, which is secured to a steel plate, which is somewhat similar in configuration to the support plate or heat sink 34 disclosed herein. The problem with this known assembly, however, is that the bimetal coil, since it is attached to the brass stud, has no means of adjustment, and is therefore susceptible to all of the above-noted variables, and therefore the time within which it is required to rotate a certain angular distance in order to be properly calibrated, may be below, within or beyond the specified time limit.

For example, in order for applicant's illustrated assembly properly to function in accordance with one requirement for calibration, the tang 50 should rotate 45° clockwise from its position as shown in FIG. 3 within, for example, 30 to 50 seconds. If, when the 7.2 volts DC is applied across the resistor 41 it takes more than 30 to 50 seconds to rotate the required 45°, then a portion of the flange 36 on heat sink 34 is removed, so that the cooling effect of the heat sink is reduced, and as a consequence a greater quantity of heat will be transmitted to the adjacent coil 48 in a shorter period of time. The result is that, the coil 48 will tend to unwind more rapidly, until it reaches the 30 to 50 second interval that is necessary for calibration purposes.

From the foregoing, it will be apparent that applicant's invention considerably simplifies and expedites the manufacture of a choke control device of the type described. Unlike prior, known devices, applicant's thermal switch or thermostat 17 is removably mounted in housing 12, so that it can be properly adjusted prior to being finally potted or secured in the housing, thereby assuring that it will open the circuit to the resistor 41 within a certain temperature range, (for example a range of 63° to 57° F.), or will close the circuit at another specified range (for example 80° to 110° F.). In practice, when the switch closes and the coil 48 is heated to expand, it, in turn, functions to open the choke valve of the associated carburetor. Moreover, by employing a separate heat sink support 34 it is possible first to stake or secure the inner end 49 of the bimetal coil 48 to the stud 46, and thereafter to punch the openings for the rivets 52 and 53 in a predetermined manner, so that upon subsequent assembly to the housing 12, the tang 50 will be properly angularly spaced from the mounting notch 61, which, in all cases can be formed on the outside of the housing wall 12 to register with a plane containing the axis of the openings in the housing that are to accommodate the rivets 52 and 53. Still a further advantage lies in employing the aluminum alloy heat sink member 34, which has the resistor 41 secured by an electrically-conductive adhesive material to the bottom of the heat sink, so that portions of the flange 36 on the heat sink can be cut away, as desired, to calibrate the coil 48 for proper operation as noted above.

While this invention has been described in detail in connection with only one embodiment thereof, it will be understood that it is capable of still further modification, and that this application is intended to cover any such modifications as may fall within the scope of one skilled in the art or the appended claims.

For example, while it has been suggested that member 34 may be an aluminum alloy casting, it will be apparent that this one-piece member may be made from any suitable material which will provide the necessary strength and heat conductive property for transferring heat rapidly from the resistor to the bimetallic coil, and which also can be readily trimmed in the area of its flange 36 to enable easy and accurate calibration of the coil. Moreover, it will be apparent also that the 120° measurement for locating the coil end 50 relative to the notch 61 is also exemplary, and in practice may differ from this exact value.

Having thus described my invention, what I claim is:

1. The method of manufacturing a choke control device of the type in which a bimetallic coil is mounted in a recess in a housing normally to have its free, outer end positioned a predetermined angular distance from a reference mark formed on the exterior of the housing, and disposed to have said free end rotate about its fixed inner end at a predetermined angular rate, when a predetermined voltage is applied across an electric heater that is mounted in the housing adjacent the coil, comprising providing a housing having a circumferential recess in one end for receiving a bimetallic coil, and having on the exterior thereof a reference mark extending parallel to the axis of said recess, providing a coil supporting member having a central, cylindrical stud portion, and a lateral flange portion projecting radially outwardly from said stud portion adjacent one end thereof, securing the inner end of a bimetallic coil to said stud portion so that the free end of said coil is rotatable angularly about the axis of said stud portion upon predetermined changes in the ambient temperature of said coil, temporarily fixturing the free end of said coil and forming a plurality of fastening holes in said flange portion of the supporting member, with the axis of at least one of said holes being angularly spaced said predetermined angular distance from said free end of the coil, and securing said flange portion of said supporting member to the bottom of said recess with the axis of said one hole lying in a plane containing said reference mark and the axis of said recess, whereby said free end of said coil will be positioned said predetermined angular distance from said reference mark.

2. The method as defined in claim 1, including removably securing a thermostatic switch in a second recess formed in said housing opposite said first recess.

3. The method as defined in claim 1, including securing a generally disc-shaped resistor-type heater to a plane surface on the side of said coil-supporting member remote from said stud portion thereof before securing said member in said recess.

4. The method as defined in claim 3, including applying said predetermined voltage across said resistor-type heater, and removing portions of said flange portion of said support member until said free end of said coil rotates at said predetermined angular rate.

* * * * *